US005473294A

United States Patent [19]

Mizzoni et al.

[11] Patent Number: 5,473,294

[45] Date of Patent: Dec. 5, 1995

[54] PLANAR VARIABLE POWER DIVIDER

[75] Inventors: Roberto Mizzoni; Rodolfo Ravanelli, both of Rome, Italy

[73] Assignee: Alenia Spazio S.P.A., Aquila, Italy

[21] Appl. No.: 398,811

[22] Filed: Mar. 6, 1995

Related U.S. Application Data

[63] Continuation of Ser. No. 215,379, Mar. 21, 1994, abandoned.

[30] Foreign Application Priority Data

Mar. 19, 1993 [IT] Italy ..... RM93A0173

[51] Int. Cl.[6] ..... H01P 5/04; H01P 5/19

[52] U.S. Cl. ..... 333/113; 333/137; 333/159; 333/253

[58] Field of Search ..... 333/109, 113, 333/115, 116, 159, 239, 243, 253, 114, 137

[56] References Cited

U.S. PATENT DOCUMENTS 2,451,876 10/1948 Salisbury ..... 333/253 X 3,621,481 11/1971 Perreault et al. ..... 333/159

4,602,227 7/1986 Clark et al. ..... 333/109

5,280,292 1/1994 Tondryk ..... 333/109 X

FOREIGN PATENT DOCUMENTS 143044 11/1979 Japan ..... 333/109

*Primary Examiner*—Paul Gensler

*Attorney, Agent, or Firm*—Cohen, Pontani, Lieberman, Pavane

[57] ABSTRACT

A novel planar variable power divider, using waveguide technology, includes two hybrids and two variable phase shifters. The variable power divider includes a variable phase shifter based on a 3 dB hybrid circuit terminated by two sliding non-contacting moveable short circuits. The differential phase spreading of the phase shifter has been reduced to less than one-sixth of typical transmission line dispersion by the compensating short terminations. As a consequence, electrical performance achievable over a 16% bandwidth is significantly improved with respect to heretofore-known variable power dividers. The variable power divider also provides for planar integration, wideband performance, medium-high power handling capabilities and low loss.

20 Claims, 3 Drawing Sheets

PLANAR VARIABLE POWER DIVIDER

This is a continuation of application Ser. No. 08/215,379, filed Mar. 21, 1994, now abandoned.

BACKGROUND OF THE INVENTION

1. Field of the Invention

This invention relates generally to microwave systems employing passive components, and more particularly, to microwave systems in which the amplitude and phase of the output signals is varied utilizing an electromechanical, variable, microwave power divider.

2. Description of the Prior Art

At the present state of the art, the solutions employed for the realization of a wave-guide variable power divider were generally based on two possible classes of configurations.

The first class of configurations employed two hybrid circuits and two complimentary variable phase shifters. The first hybrid circuit, with orthogonal output gates ("T" type), generated, from the input signal, two signals of equal amplitude at its outputs, which signals were subjected to a relative phase shift by the variable phase shifters. The second circuit then recombined these signals, so that one of the two outputs gave the sum of the two signals and the other the difference between the two signals. In this manner two signals were generated, the amplitudes thereof depending upon on the electric phase-shifting angle introduced by the variable phase shifters, according to two sine functions in quadrature to each other. The critical feature of this solution resides in the fact that the actuating element for power regulation was the electrical phase-shift angle, which by nature depends on the frequency, and this fact inevitably limited the variable power divider's inband performance. The second class of variable power divider configurations utilized a variable polarization rotator between two linear polarization separators known as "OMT" (Ortho Mode Transducers). Since the output gates were not aligned, dividers of this type could not be easily integrated into more complex planar networks.

The solutions regarding the first class of configurations have several disadvantages. For example, the first input hybrid circuit is of the "T" type, i.e., with one of the two gates outside the plane containing the device's circuitry development, and therefore it does not allow the planar development of the device. Moreover, the circuitry layout of the proposed components, in the event that the variable phase shifters are constituted by hybrids short-circuited at the output, is generally of the "cross" type, i.e., with the 4 hybrids set out perpendicularly to one another; this makes it impossible to optimize the dimensions and limits the possibility of integrating the device in beam-forming networks. Further, the movable short-circuits made with sliding contacts or small distances in relation to the waveguide containing them, can cause discharge or radio frequency power loss phenomena when high powers are used. Finally, the phase response obtainable from variable phase shifters is closely linked to the scatter from the short-circuited line segment, and this entails considerable amplitude and phase variations in the device's inband output in relation to the central frequency value.

The solutions applying to the second class of configurations have the disadvantage of preventing the integration of the device in more complex planar networks.

It is therefore an object of the present invention to provide an easily integratable, low-loss, broad-band variable power divider which is operable at medium-to-high power levels.

It is also an object of the present invention to provide a circuit configuration in which the output gates of the first input hybrid circuit are disposed in the same plane, thereby permitting a planar construction.

It is a further object of the present invention to provide a circuit configuration which utilizes non-sliding, movable short circuits with resonant cavities, thereby avoiding the problems of discharge or radio frequency power loss experienced by prior art devices at high powers.

It is yet another object of the present invention to provide a circuit which can be integrated into complex planar networks.

SUMMARY OF THE INVENTION

The foregoing and additional objects, which will hereinafter become apparent to those skilled in the art, are achieved in accordance with the present invention by a divider circuit which employs, as first and second variable phase shifters, two hybrid circuits with outputs closed by first and second movable short-circuits.

The microwave variable power divider that is the subject of the present invention can be considered a further development of the first class of prior art configurations discussed above and comprises a 3 dB directional coupler hybrid circuit, followed on one output leg by a variable phase shifter, obtained by assembling a −3 dB directional coupler with its outlets closed by movable short-circuits that facilitate its variability. The hybrid circuit is followed on the other output leg by a 90-degree differential phase shifter and an analogous variable phase shifter consisting of a directional coupler and movable short-circuits, followed by another directional coupler. The device makes it possible to vary the power on the two output legs in a complimentary manner by regulating the movement of the movable short-circuits. The particular solution proposed allows the use of a planar-type technology, which can assure considerable advantages in terms of construction, dimensions and integration in more complex networks. In addition, the operating bandwidth (≦16%) associated with low losses (0.15 dB) and minimal inband variation of amplitude at the outputs in relation to any desired power division value constitute the peculiar characteristics of this device. Lastly, the low level of passive intermodulation products allows the device to operate in multicarrier systems and the particular movable short-circuit solution adopted allows it to be used for medium-high powers (300 W in continuous wave radiofrequency).

As indicated above, the device is designed to be constructed employing planar (or clam shell) technology, whereby the various component pans are made in two specular halves (half-shells) that are subsequently assembled. In particular, the hybrids used are all "H" type, i.e., they consist of directional couplers of the type with the coupling cavity in the plane containing the electrical field E ("E plane") of the fundamental mode (mode $TE_{10}$) of electromagnetic propagation with input and output in the same plane. This technology offers the following advantages from the electrical functional standpoint: minimization of the ohmic losses of the various components constituting the device, since separation into their two constituent halves occurs in a zone where currents are not excited for the fundamental mode (mode $TE_{10}$) propagated in the rectangular waveguide; and low level of passive intermodulation products, in the event that several carriers are utilized, since non-linearity phenomena are not excited.

With reference to the mechanical and constructional aspects of the device, its advantages are as follows: easy integration into more complex microwave networks, such as antenna beam forming networks used to produce radiation beams of variable shape (reconfigurable beams) and networks devoted to channelling multi-carrier radiofrequency (RF) systems (these networks are used before or after the multiplexers to direct the channels towards different output gates); the whole assembly machine may be machined as two half-shells using numerical control machine tools, with consequent cost savings; and very limited dimensions, thanks to the particular component layout, based on hybrids set side by side in pairs, with the use of curved waveguide stretches having a particularly small bending radius.

The movable short-circuits, which together with the hybrid constitute the variable phase shifter, consists of a movable metal body kept centered and at an appropriate distance (≧ 1 mm) from the walls of the rectangular waveguide containing it, with the consequent advantage of avoiding sliding contact between the metal body that constitutes the movable part of the short-circuit and the waveguide that contains it, preventing the occurrence of multipactor effect discharges or breakdown discharges in the event that the device is used in a medium-high power apparatus (≦8 KW peak).

To perfect the movable short-circuit, the waveguide containing the movable body of the circuit has been provided with resonant cavities on the "E plane" and a discontinuity introduced by widening the dimensions of the waveguide in the plane orthogonal to the preceding one in relation to the guide's dimensions in the rest of the device, with the following advantages: minimizing radiofrequency power losses from the short-circuit that could pass beyond the movable body, thus avoiding fixed or sliding contacts; and minimizing inband phase variation in relation to the central frequency value of the variable phase shifter constituted by the short-circuited transmission line (waveguide), consequently optimizing the device's inband response and limiting its amplitude dispersion. Other advantages of the solutions adopted are: the adaptability of the device to all frequency bands using a rectangular waveguide (for typical frequencies from 6 GHz to 60 GHz); and the possibility of actuating the movement of the short-circuit's movable bodies by a motor with an opposed stirrup or a linear actuator of the stepping motor type.

The various features of novelty which characterize the invention are pointed out with particularity in the claims annexed to and forming a part of the disclosure. For a better understanding of the invention, its operating advantages, and specific object attained by its use, reference should be had to the drawing and descriptive matter in which there are illustrated and described preferred embodiments of the invention.

BRIEF DESCRIPTION OF THE DRAWINGS

The features and advantages of the present invention will be more readily understood from the following detailed description when read in conjunction with the accompanying drawings, in which.

DETAILED DESCRIPTION OF THE PREFERRED EMBODIMENTS

Figure 1:
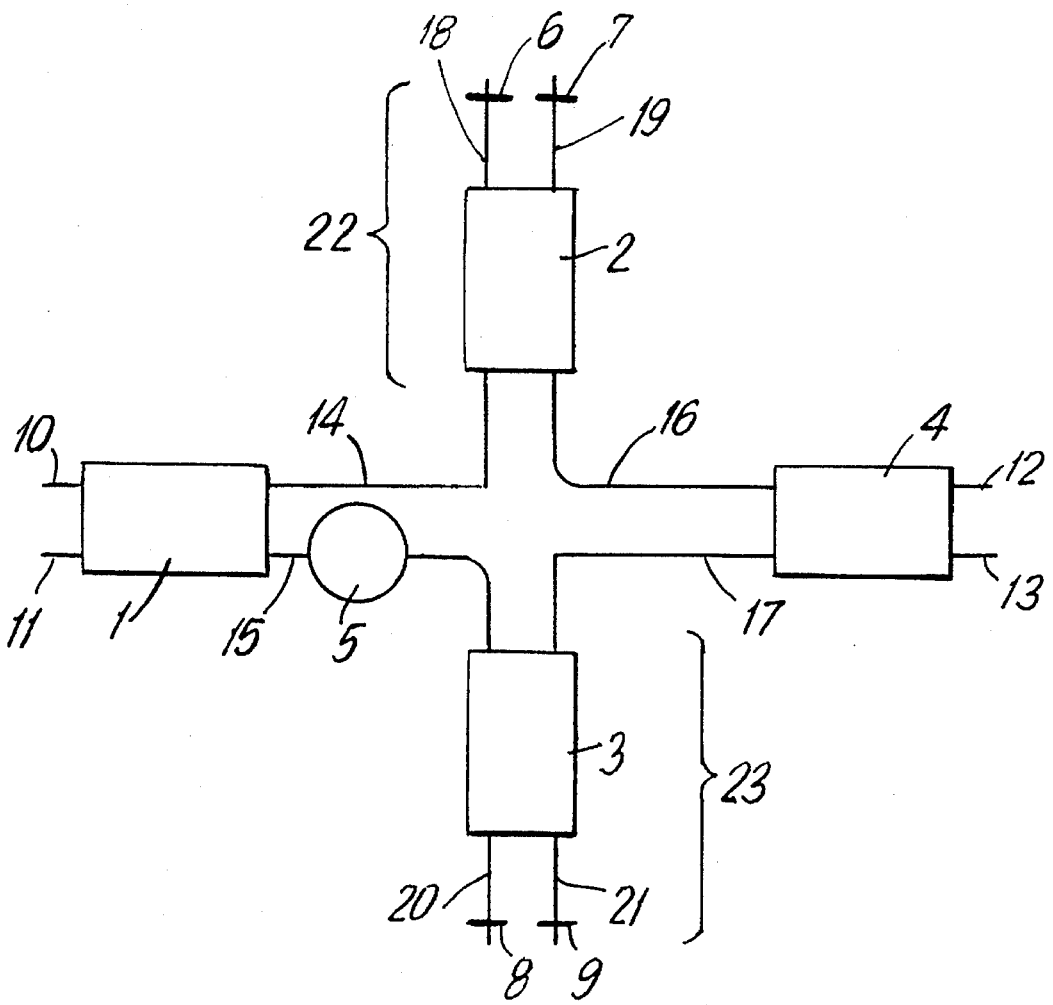
FIG. 1 is a block diagram depicting a power divider circuit constructed in accordance with the present invention.

With initial reference to FIG. 1, the operation of a circuit constructed in accordance with the invention will be described. As seen in FIG. 1, the circuit comprises a 3 dB input directional coupler 1, a pair of directional couplers 2 and 3 which comprise variable phase shifters 22 and 23, respectively, and a 3 dB output directional coupler 4. The signal at input 10 is divided, by type "H" hybrid 1, equally between the two lines 14 and 15. The signal on line 15 has a 90-degree phase delay in relation to the one on line 14. The phase shifter 5 and an appropriate lengthening of line 14 makeup for this delay, so that the two signals phases coincide at the input of their respective hybrid circuits 2 and 3.

In other words, at the outputs of hybrid circuit 1, the signal on line 15 has a phase shift of 90 degrees with respect to the signal on line 14. At the output of phase shifter 5, the difference of phase is cancelled. The signal on line 14 is, in turn, split equally by hybrid 2 into two signals travelling along lines 18 and 19, where they are reflected by short-circuits 6 and 7, and pass back through the same hybrid 2, recombining so that all the power is channelled onto line 16. Likewise, the signal on line 15 is split equally by hybrid 3 into two signals travelling along lines 20 and 21, where they are reflected by short-circuits 8 and 9, and pass back through the same hybrid 3, recombining so that all the power is channelled onto line 17.

As will be readily ascertained by those skilled in the art, the phase of the signal on line 16 is proportional to the length of the line between the outputs of hybrid 2 and movable short-circuits 6 and 7. Likewise, the phase of the signal on line 17 is proportional to the length of the line between the outputs of hybrid 3 and movable short-circuits 8 and 9. The position of the movable short-circuits is adjusted in such a manner that when short-circuits 6 and 7 approach, by a certain distance, the outputs of hybrid 2, short-circuits 8 and 9 are separated, by the same distance, from the outputs of hybrid 3. Consequently, the variable phase shifters 22 and 23, each of which consists of a hybrid plus a movable short-circuit, ensure that the phases of their output signals are equal but opposite in sign.

The signals on lines 16 and 17 are finally combined by hybrid 4 on outputs 12 and 13 so as to obtain the division of all the power entering the device in a complimentary manner. The power at outputs 12 and 13 is proportionate to the phase of the signals on lines 16 and 17. It therefore depends on the position of the movable short-circuits pair 6 and 7 in relation to pair 8 and 9.

Figure 2:
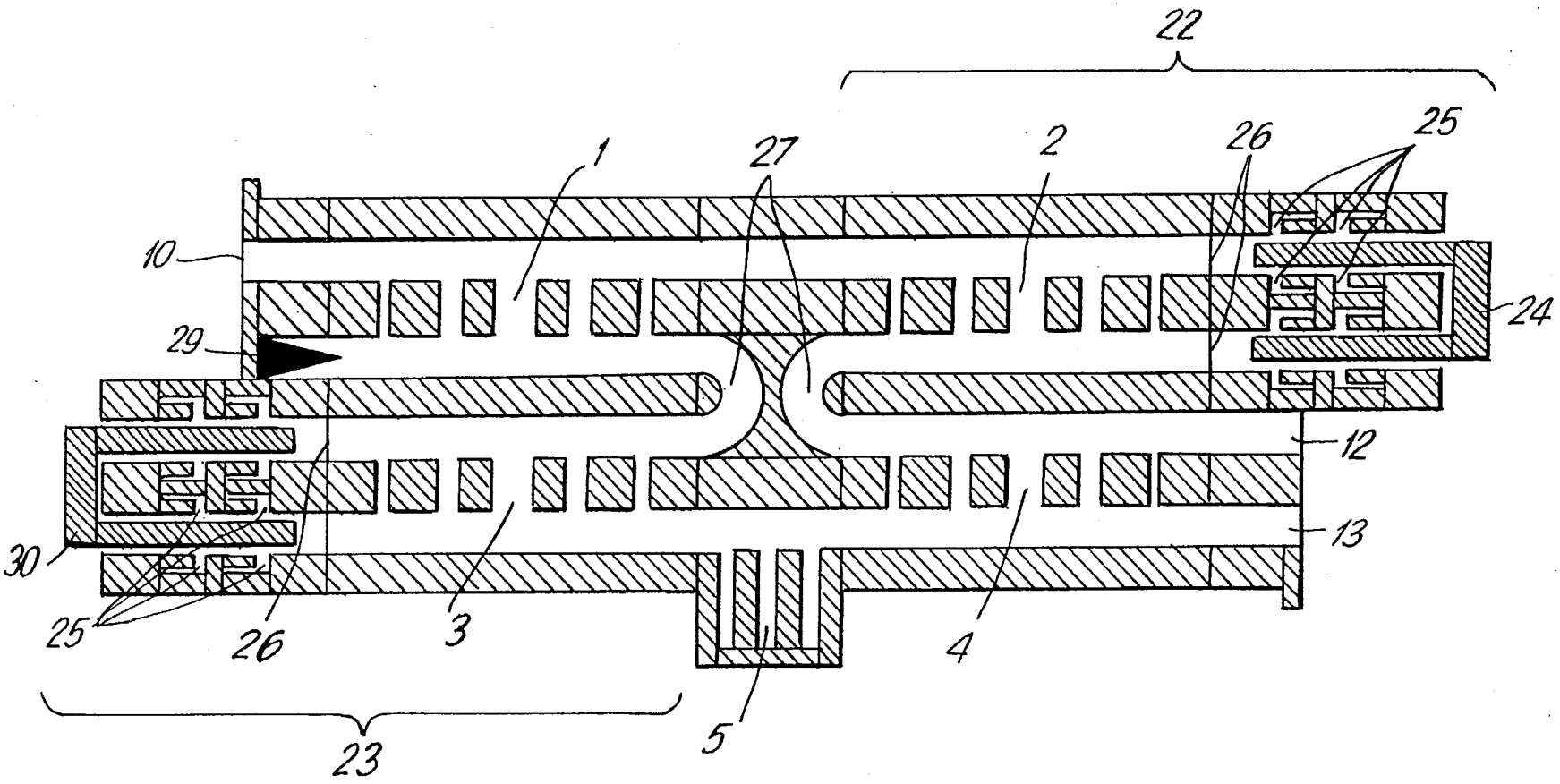
FIG. 2 is a view in cross section showing the construction details of the variable phase shifters of the present invention.

With reference to FIG. 2, the construction of an illustrative embodiment of the present invention will now be described in detail. FIG. 2 depicts the interconnection section of two half-shells which comprise the device. This section coincides with "plane E", the propagation plane of the electromagnetic field's fundamental mode in a rectangular waveguide.

All the hybrids depicted in FIG. 2 are of the branch guide coupler type, i.e. directional couplers with coupling cavities on "plane E" between two parallel waveguides running along the wide side of their section. Hybrids 1 and 3 are parallel and opposite to hybrids 2 and 4. The parallel hybrids are connected through the "U" bends 27, which have an internal step to optimize electrical performance with a minimal bending radius.

With continued reference to FIG. 2, the 90-degree stationary phase shifter 5 is located in the orthogonal section of waveguide connecting hybrid 3 to hybrid 4. This phase shifter, as indicated in FIG. 1, is located between hybrids 1 and 3. FIG. 2 shows the variable power divider's working configuration. The reason for moving phase shifter 5 to the position located between hybrids 3 and 4 is to reduce the overall dimensions of the structure. Phase shifter 5 is of the type with resonant cavities in "plane E", with an extremely flat inband differential electric phase constant (±0.2 degrees).

Figure 3A:
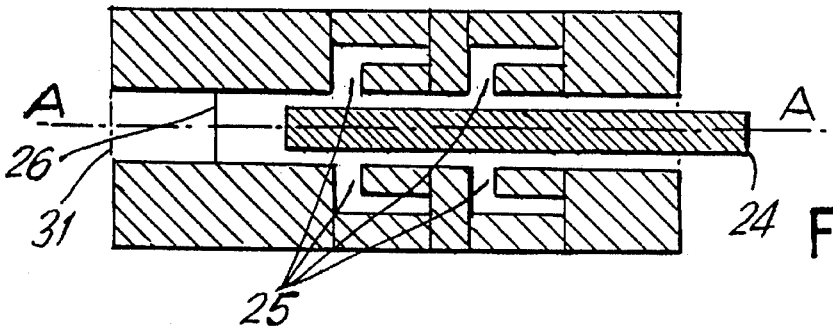
FIG. 3A is a cross sectional elevation view of a first embodiment of a movable short-circuit element employed by the present invention.
Figure 3B:
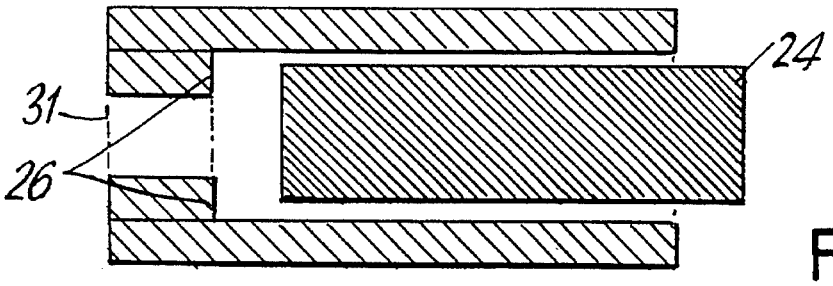
FIG. 3B is a cross sectional plan view of the movable short circuit element of FIG. 3A, taken across plane A—A thereof.

The movable short-circuits are located at the outer end of hybrids 2 and 3, and they are moved by a mechanical arm and a motor, not shown in FIG. 2, which ensure that movable bodies 24 and movable bodies 30 move by the same distance but in opposite directions. With reference to FIGS. 3A, and 3B, the movable short-circuits include a metal movable body 24 kept centered inside the waveguide at the necessary distance from the sides to prevent discharge phenomena (≧1 mm in "plane E" and 0.2 mm in the orthogonal plane). The movable short circuits further include a rectangular waveguide whose larger side is greater than the larger side of the waveguide in which the remainder of the device is located, so that the variations in dimension produces a step discontinuity 26 in the guide. The movable short circuits also include four cavities, in two symmetrical pairs in "plane E", which may be either of the bent L-shaped type (this is the solution preferred at present by the inventors, and is shown in detail 25 in FIG. 3A), or of the I-shaped type; in the second case these may be air cavities or may contain dielectric material (alternative solution shown in detail 28 in FIG. 4B).

Figure 4A:
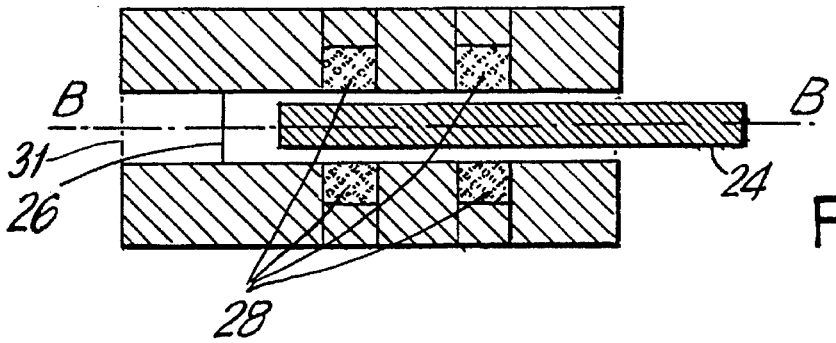
FIG. 4A is a cross sectional elevation view of a second embodiment of a movable short-circuit element employed by the present invention.
Figure 4B:
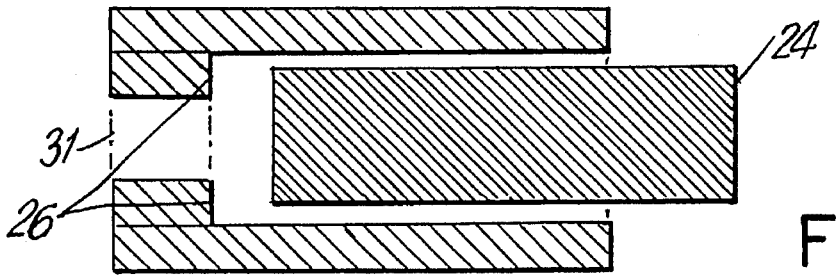
FIG. 4B is a cross sectional plan view of the movable short circuit element of FIG. 4A, taken across plane B—B thereof.

The movable part of the short-circuit, consisting of metal body 24, is located between step discontinuity 26 in the guide and cavities 25 (FIGS. 3A and 3B), or else, in the alternative embodiment shown in FIG. 4A and 4B, between discontinuity 26 and cavities 28. The reciprocal distances between the cavities, the discontinuity and the various positions that the movable body must assume to accomplish the desired phase shift are optimized so as to minimize the inband phase shift variation of the signal coming from the short-circuit in relation to the value desired at the central frequency, and so as to minimize the radiation losses due to the fact that movable body 24 is not in contact with the waveguide containing it.

With regard to minimizing inband phase shift variation, it should be noted that in the absence of the movable short-circuit proposed herein, the inband phase dispersion obtained in accordance with prior art approaches would have been related to the variation in the length of the transmission line from output 31 of the short-circuit (shown in FIG. 3A or 4A) to the position of movable body 24. With the solution presented herein, this dispersion is compensated for by the effect of step discontinuity 26 and cavities 25 or 28 located in the waveguide. In fact, the variable distance between discontinuity 26 and movable body 24 assures both the desired phase shift (because of the variation in the length of the transmission line) and the phase dispersion compensation effect, since discontinuity 26 introduces a phase with an opposite inband shape to the phase shape introduced by the distance between discontinuity 26 and movable body 25.

It follows that the differential phase shift between variable phase shifters 22 and 23 shown in FIG. 2, consisting of hybrids 2 and 3 short-circuited at their outputs by the movable short-circuits shown in FIG. 3A or 4A, is sufficiently constant along the entire band of interest. The maximum phase dispersion between variable phase shifters 22 and 23, obtained with the use of these short-circuits, is ±2 degrees in the case of a desired differential phase of 90 degrees, instead of ±13 degrees as is the case with the short-circuits used at present. Since the device's inband power division is a function of the differential phase, the reduction of phase dispersion brings about a substantial improvement in the electrical performance of the device.

The configuration of elements in accordance with the present invention makes it possible to achieve a planar construction utilizing two specular half shells joined to one another ("clam shell" technology). As such, the present invention offers the advantages of easy integration, minimization of ohmic losses, and easy manufacture. With particular reference to the movable short circuits of the present invention, it will be readily ascertained by those skilled in the art that inband phase dispersion can be minimized (thereby minimizing output amplitude variation as a function of frequency), and that the variable power divider can be used for medium-high powers (i.e. 300 to 600 W).

The circuit of the present invention avoids the disadvantages of the first class of prior art configurations discussed above. More particularly, the substitution of an "H-type" input hybrid and 90° differential phase shifter for the "T-type" input hybrid of the prior art makes it possible to fabricate a circuit having equivalent electrical functions and having co-planar output gates. Thus, it is now possible to achieve a planar design. Further, the use of non-sliding movable short-circuits with resonant cavities makes it possible to avoid, at high powers, the discharge or radio frequency power loss phenomena associated with the use of sliding contacts or small distances in relation to the waveguide containing the short-circuits.

The phase response obtainable from variable phase shifters is closely linked to the scatter from the short-circuited line segment. Thus, in prior art devices, there are considerable amplitude and phase variations in the device's inband output in relation to the central frequency value. In accordance with the present invention, however, the waveguide containing the movable body of the circuit is provided with resonant cavities on the "E plane" and a discontinuity introduced by widening the dimensions of the waveguide in the plane orthogonal to the preceding one in relation to guide's dimensions in the rest of the device. Such a configuration achieves a substantial reduction in scatter when compared to prior art devices.

It will, of course, be appreciated by those skilled in the art that the invention is not limited by the embodiments described above which are presented as examples only but can be modified in various ways within the scope of protection defined by the appended patent claims.

What is claimed is:

1. A variable power divider circuit for use in microwave systems, comprising:

first, second, third and fourth waveguide transmission lines;

first and second variable phase shifting means, each of said variable phase shifting means including: an output, a directional coupling means, and a pair of movable, non-sliding short circuits, each of the movable, non-sliding short circuits being coupled through the directional coupling means to the output of the respective variable phase shifting means; and third and fourth directional coupling means, respective outputs of said third directional coupling means being coupled, through the first and second waveguide transmission lines, to corresponding inputs of said first variable phase shifting means and said second variable phase shifting means, and respective inputs of said fourth directional coupling means being coupled, through said third and fourth waveguide transmission lines, to corresponding outputs of said first and second variable phase shifting means.

2. The variable power divider circuit of claim 1, wherein said microwave system is an antenna beam forming network.

3. The variable power divider circuit of claim 1, wherein said microwave system is a multi-carrier RF channelling network.

4. The variable power divider circuit of claim 1, wherein said movable-short-circuits are dimensioned and arranged for operation in a medium-high power range of 300 W to 600 W.

5. The variable power divider circuit of claim 1, wherein each of said movable short-circuits comprises an empty L-shaped resonant cavity and a step discontinuity.

6. The variable power divider circuit of claim 1, wherein each of said movable short-circuits comprises an I-shaped resonant cavity.

7. The variable power divider circuit of claim 6, wherein at least one of said I-shaped cavities contains dielectric material.

8. The variable power divider circuit of claim 1, further including a 90 degree phase shifter interconnected between an output of said third directional coupling means and an input of one of said variable phase shifting means.

9. The variable power divider circuit of claim 1, wherein said variable phase shifting means and directional coupling means are defined by coupling cavities disposed between parallel waveguides.

10. The variable power divider circuit of claim 9, wherein said variable phase shifting means and directional coupling means are disposed in coplanar relation.

11. The variable power divider circuit of claim 9, wherein said third directional coupling means and said second variable phase shifting means are disposed parallel to one another and are disposed opposite said first variable phase shifting means and said fourth directional coupling means, respectively.

12. The variable power divider circuit of claim 9, wherein said third directional coupling means and said second variable phase shifting means, and said first variable phase shifting means and said fourth directional coupling means are connected by first and second U-shaped waveguide sections, respectively.

13. The variable power divider circuit of claim 12, wherein each of said U-shaped waveguide sections defines a step discontinuity.

14. The variable power divider circuit of claim 12, wherein each of said short-circuits comprises a metal member having a first section movable within a leg of a respective U-shaped wavelength section and a second section movable within a corresponding one of said parallel waveguides.

15. The variable power divider circuit of claim 12, wherein each of said short-circuits defines a plurality of resonant cavities disposed in symmetrical pairs, said resonant cavities being disposed in a fundamental mode propagation plane.

16. The variable power divider circuit of claim 15, wherein said cavities are filled with a dielectric material.

17. The variable power divider circuit of claim 15, wherein said cavities are L-shaped in cross section.

18. The variable power divider circuit of claim 15, wherein said cavities are I-shaped in cross section.

19. The variable power divider circuit of claim 15, wherein a first short-circuit of each of said variable phase shifting means is disposed in a corresponding one of said parallel waveguides.

20. The variable power divider circuit of claim 19, wherein a second short-circuit of each of said variable phase shifting means is disposed in a corresponding U-shaped waveguide section.

* * * * *